United States Patent [19]

Coates

[11] Patent Number: 4,566,130

[45] Date of Patent: Jan. 21, 1986

[54] COMBINATION CARRYING BAG FOR INFANT ACCESSORIES AND DIAPERING STATION

[76] Inventor: Fredrica Coates, 1608 Dublin Rd., Charlottesville, Va. 22903

[21] Appl. No.: 482,722

[22] Filed: Apr. 7, 1983

Related U.S. Application Data

[63] Continuation-in-part of Ser. No. 465,371, Feb. 10, 1983.

[51] Int. Cl.[4] ..... A45C 9/00; A45F 4/06

[52] U.S. Cl. ..... 383/15; 383/4; 190/1; 190/117; 150/106

[58] Field of Search ..... 190/1, 2, 100; 150/34, 150/35, 100, 106, 107, 117; 206/223; 383/4, 15

[56] References Cited

U.S. PATENT DOCUMENTS

| | | | |
|---|---|---|---|
| 909,248 | 1/1909 | Staeger | 383/15 X |
| 954,840 | 4/1910 | Wiedemann | 383/4 X |
| 1,653,246 | 12/1927 | Zichy | 206/223 X |
| 2,105,319 | 1/1938 | Hedden et al. | 383/4 X |
| 2,315,126 | 3/1943 | Michalke | 383/4 X |
| 2,730,151 | 1/1956 | Smith | 383/40 X |
| 2,865,433 | 12/1958 | Warner | 383/4 X |
| 2,870,464 | 1/1959 | Lalick | 5/334 |
| 3,052,895 | 9/1962 | Lo Vico | 383/4 X |
| 3,143,748 | 8/1964 | Manning | 190/2 X |
| 3,301,295 | 1/1967 | Fitch | 150/34 |
| 3,489,194 | 1/1970 | Hoover | 190/2 X |
| 4,068,786 | 1/1978 | Taniguchi | 190/2 X |
| 4,074,740 | 2/1978 | Anderson | 383/4 X |
| 4,154,323 | 5/1979 | Sneider | 383/40 X |
| 4,190,918 | 3/1980 | Harvell | 190/2 X |

FOREIGN PATENT DOCUMENTS

| | | | |
|---|---|---|---|
| 303540 | 2/1918 | Fed. Rep. of Germany | 224/156 |
| 680949 | 9/1939 | Fed. Rep. of Germany | 150/34 |
| 679562 | 1/1930 | France | 150/34 |
| 2478972 | 10/1981 | France | 190/1 |
| 316848 | 8/1929 | United Kingdom | 150/34 |
| 2061712 | 5/1981 | United Kingdom | 190/2 |

*Primary Examiner*—William Price
*Assistant Examiner*—Sue A. Weaver
*Attorney, Agent, or Firm*—Lowe King Price & Becker

[57] ABSTRACT

A diapering station formed of a single piece of material is divided by fold lines into three successive sections to cushion an infant on a support surface and store infant accessories for diaper changing. The diapering station is converted into a carrying bag for infant accessories by folding the two end sections inwardly, one over the other along the fold lines, onto the middle section, enabling the bag to be conveniently carried by a combination handle and back pack strap. A waterproof, removable pouch on the middle section of the station provides a clean surface for the infant's bottom and stores dirty diapers for subsequent washing. An inwardly opening pocket formed in one of the end sections of the station stores clean diapers, and storage of infant assessories such as bottles and food jars is provided in additional pockets formed in the other end section of the station. A cylindrical, bib storage pouch adjacent the strap handle in the station provides stiffness to the unit, folded to form the carrying bag. The ergometric design of the station positions diapers and accessories within close reach of the attendant during diaper changing.

17 Claims, 19 Drawing Figures

Fig. 2A
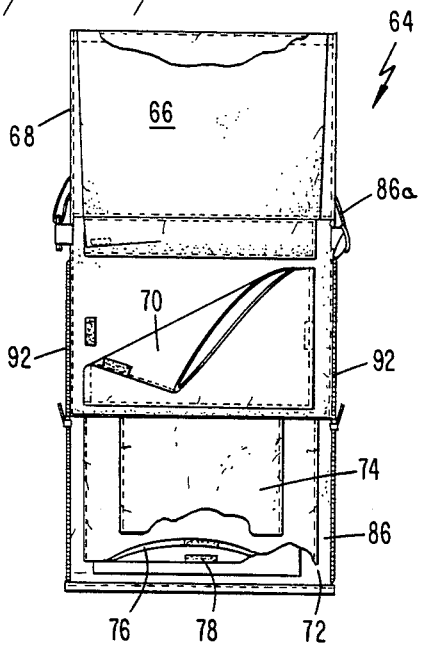
Fig. 2B
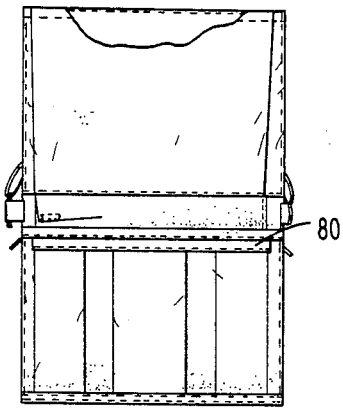
Fig. 2C
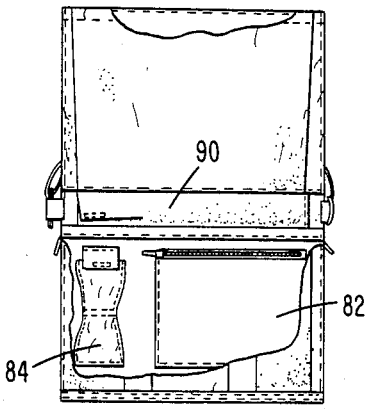
Fig. 2D
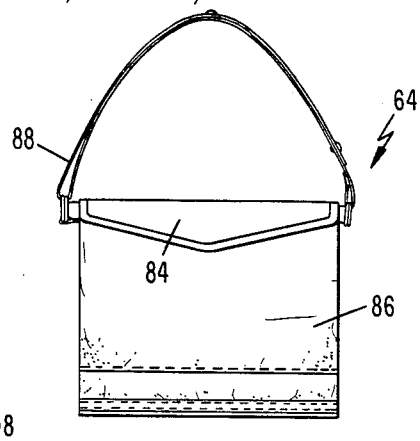
Fig. 2E
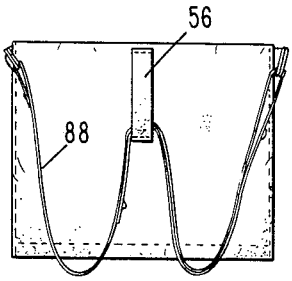
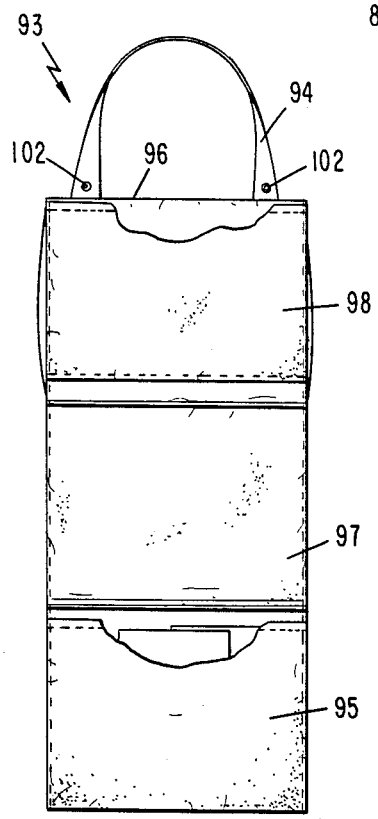
Fig. 3A
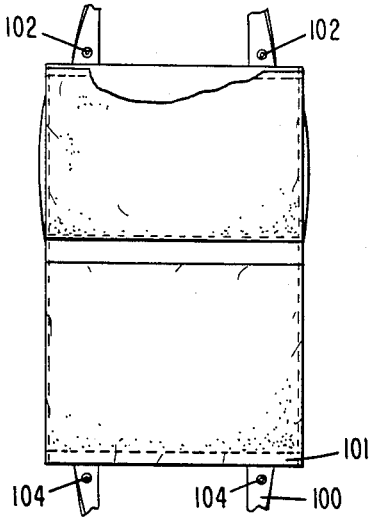
Fig. 3B
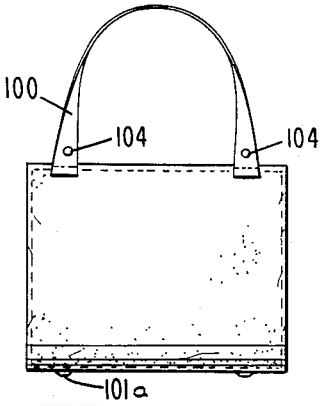
Fig. 3C

COMBINATION CARRYING BAG FOR INFANT ACCESSORIES AND DIAPERING STATION

CROSS REFERENCES TO RELATED APPLICATIONS

This application is a continuation-in-part of application Ser. No. 465,371 filed on Feb. 10, 1983.

TECHNICAL FIELD

This invention relates generally to infant accessories carrying bags, and more particularly toward a combination carrying bag and diapering station having multiple storage pockets and conveniences.

BACKGROUND ART

Diaper changing bags and stations such as the ones disclosed in Hoover U.S. Pat. No. 3,489,194, Taniguchi U.S. Pat. No. 4,068,786 and Sneider U.S. Pat. No. 4,154,323 provide a cushioned surface for a baby during diaper changing and store diapers and other baby supplies and accessories. These products, although generally useful, tend to be cumbersome to fold and carry, inconvenient to use and expensive. There still exists a need for a diaper station that is compact, convenient, inexpensive, and above all, safe for the infant.

DISCLOSURE OF INVENTION

It is accordingly one object of the present invention to provide a combination diapering station and carrying bag that provides safety to the infant during diaper changing and presents accessories within close reach of the attendant.

Another object is to provide a diapering station that cushions the infant's body and provides additional support to the head for comfort and safety during diaper changing.

A further object is to provide a diapering station that establishes a sanitary region for an infant during diaper changing, insulating the body from the support surface and hygienically isolating dirty diapers.

A still further object of the invention is to maximize storage and utilitarian efficiencies in a combination diaper changing station and carrying bag by applying dual functions to various structures constituting the unit.

An additional object is to provide a diaper and infant accessories carrying bag that is alternatively carried as a handbag and back pack.

A further object of the invention is to form a combination diapering station and carrying bag of a single piece of material to reduce costs by minimizing sewing steps and eliminating cutting.

An additional object of the invention is to improve infant safety in a diapering station by isolating hard, bulky objects such as bottles and jars from the infant's body during diapering while employing soft articles such as diapers to cushion the head.

These and other objects of the invention are satisfied in accordance with the invention by providing a diapering station formed of a single piece of material divided into three successive sections by fold lines. The station is laid flat on a support surface to cushion and isolate the infant during diaper changing. To convert the station to a carrying bag, the two end sections are folded inwardly, one over the other, onto the middle section, sealed and carried by hand or as a back pack using a convertible strap.

One of the end sections is formed with a pocket that opens inwardly toward the center section and has a size corresponding to the size of a standard diaper. Clean diapers are retained within the pocket when the end section is folded to form the carrying bag. The pocket, stuffed with diapers, cushions the infant's head during diaper changing. A number of additional pockets formed in the opposite end section of the station provide storage for other infant supplies and accessories, such as bottles, jars, pacifiers, etc. These supplies and accessories are maintained away from the infant's body during diaper changing to avoid injury.

The middle section of the diapering station carries a removable, waterproof pouch that is positioned beneath the infant's bottom during diaper changing, providing a waterproof surface. Dirty diapers are sealed within the pouch. Subsequently, at a convenient time, the pouch is removed from the diapering station, unsealed and the dirty diapers pulled for washing.

The one piece construction of the bag is established by folding material over to form pockets, doubling the material back to define a base and sewing the handle to folds formed in the outer surface of the material. Storage efficiency is maximized by synergistic design wherein stored items establish rigidity and balance to the bag and cushioning to the station.

Still other objects of the present invention will become readily apparent to those skilled in this art from the following description wherein there is shown and described preferred embodiments of this invention, simply by way of illustration of one of the best modes and alternative embodiments contemplated for carrying out the invention. As it will be realized, the invention is capable of still other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

FIG. 2A shows a second embodiment of the invention, unfolded, and illustrating removal of the washable diaper pouch;

FIG. 2B illustrates a first fold step, with one end section layered onto the middle section of the station;

FIG. 2C shows a cut-away portion of the folded over end section to expose a pair of accessory pockets;

FIG. 2D is a front view of the converted carrying bag including carrying strap;

FIG. 2E is a rear view of the bag, with the carrying strap threaded through the back strap loop;

FIG. 3A shows a third embodiment of the invention, unfolded, and carrying diapers in one end section pocket;

FIG. 3B illustrates the station following a first fold, with both handles now exposed;

FIG. 3C shows the diaper bag converted from the station of FIG. 3A;

BEST MODE FOR PRACTICING THE INVENTION

Figure 1A:
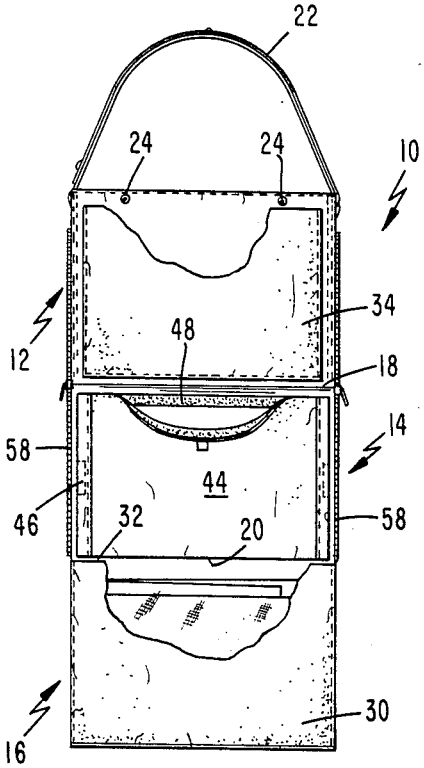
FIG. 1A is a view of one embodiment of a combination diapering station and carrying bag of the invention, unfolded to expose the three diapering station sections.
Figure 1B:
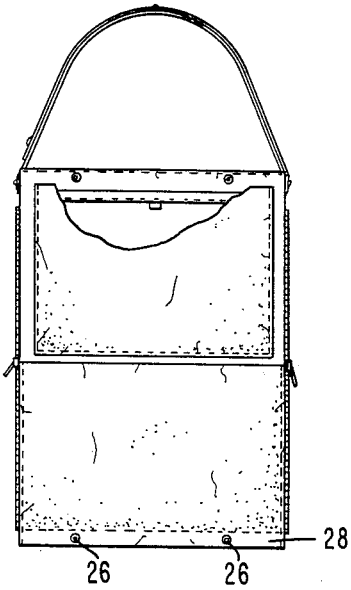
FIG. 1B shows one folding step to convert the station of FIG. 1A to a carrying bag.
Figure 1C:
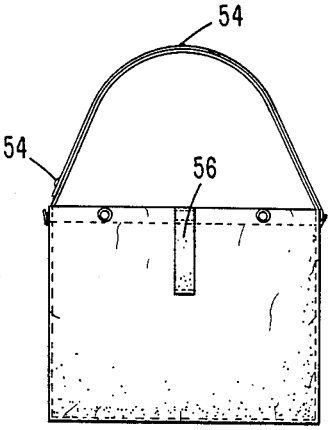
FIG. 1C is a rear view of the station, folded to form a carrying bag, exposing the rear back pack loop.

In accordance with a first preferred embodiment of the invention shown in FIGS. 1A–1F, a combination diapering station and carrying bag 10 is formed of a single piece of material that may be fabric, plastic or other waterproof material or a combination of the two, i.e., a fabric outer layer and waterproof inner layer, sewn or bonded together. The diapering station 10 has three successive sections 12, 14 and 16 separated by fold lines 18 and 20. A strap 22 at one end of the station 10 functions as a carrying handle when the station is folded to form a carrying bag. This is done by folding end section 16 upwardly along line 20 onto middle section 14 as shown in FIG. 1B, and then folding the center section along line 18 into end section 12 (FIG. 1C). The bag is maintained closed by snap fasteners 24 at the outer end of section 12 and 26 that are on a fold or flange 28 behind fold line 20. The fold or flange 28 is formed by pinching material at the outer surface of the station along fold line 20 and stitching or bonding to form a permanent flange. This type of manufacturing enables the diapering station to be formed of a single piece of material without handling additional strips or pieces to establish or reinforce the flange.

Returning to FIG. 1A, end section 16 has a pocket 30 that opens inwardly at 32 to receive and retain diapers or other articles. Because the pocket 30 opens inwardly, with the mouth 32 of the pocket positioned adjacent fold line 20, diapers and other contents are retained within the pocket 30, without requiring any pocket cover or flap, when the end section 16 is folded onto middle section 14.

Cloth diapers are preferably retained within the pocket 30, and for convenience, the size of the pocket is made to conform to the size of a cloth diaper. Paper diapers can, of course, also be stored in pocket 30 but to prevent sliding about, a strap or other hold down means (not shown) is preferably provided in the pocket to prevent sliding. Additionally, other items such as coloring books, note pads, etc. can be stored in the pocket to entertain an older youngster. This is particularly advantageous since the station 10 could, in practice, be used as a toy or training device for a youngster, rather than as a diapering station used by an adult.

The pocket 30 is preferably formed by doubling back material and sealing the sides by stitching or bonding, again eliminating need for additional material, cutting or other manufacturing steps. The resultant pocket 30, with its opening 32 at middle section 14, locates clean diapers as close as possible to the infant during diapering, thereby optimizing ergometrics and minimizing diapering time. Furthermore, and of particular importance, the pocket 30 helps cushion and support the infant's head during diaper changing, with the rest of his body across the middle section 14 and opposite end section 12. This also results in a more compact bag, when folded, because unlike prior art designs wherein foam or other nonfunctional padding tends to waste space, the padding in pocket 30 is itself functional, constituted by diapers or other paraphernalia which would otherwise be carried elsewhere in the bag.

The opposite end section 12 is provided with a number of additional pockets to store other infant supplies and paraphernalia, such as bottles and jars, pacifiers, toys, etc. These supplies are maintained away from the body of the infant during changing, minimizing the likelihood of injury and helping maintain the balance and rigidity of the bag. Referring to FIG. 1A, pocket 34 is available to store miscellaneous flat items, including diapers, and a further, preferably zippered pocket 36 is provided on the outer surface of the section 12 (see FIG. 1E). The pocket 36 may conveniently hold relatively small but cumbersome objects, such as pacifiers, toys, key rings, etc., out of the infant's reach but conveniently accessible to the mother, father or attendant. An additional, larger, preferably zippered pocket 38 shown in FIG. 1E stores infant bottle and food jars within the side sleeves 40 and optional closure flaps 42. The bottles or jars are maintain erect within the pocket 38 by the sleeves 40, maintaining the rigidity of the bag while protecting the bottles or jars from damage by contact. Furthermore, because the sleeves 40 retain the bottles or jars at the sides of the bag, the useable pocket space within the bag is maximized. An elastic band 41 on each sleeve helps separate food jars within the sleeve.

Within the center section 14 is located a removable, preferably plastic pouch 44, retained to the middle section by a number of Velcro or equivalent strips 46. The pouch 44 has an open side 48 that is sealable by a Velcro or equivalent fastening strip. The pouch 44 provides a convenient work surface for the station, insulating and cushioning the bottom of an infant during diaper changing. As the dirty diaper is removed from the infant, it is inserted into the pouch 44, and the pouch is sealed. Moisture is retained within the pouch, which is waterproof and sealed along edge 48. Following diapering, the pouch 44 may be placed in pocket 34 and subsequently the pouch 44 and dirty diapers removed and washed for reuse.

Figure 1D:
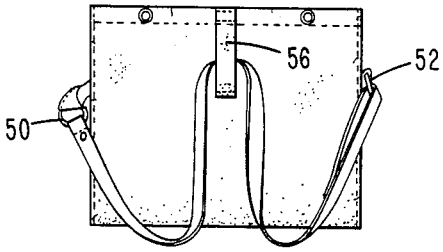
FIG. 1D shows the carrying strap threaded through the back pack loop ready to be supported by the shoulders of the user.

Handle 22 is preferably formed of a fabric strap attached to one side of the bag/station 10 (FIG. 1D) at a ring 50, looped through a second ring 52 at the opposite side and doubled back, snapped between strap layers by snaps 54, shown in FIG. 1C, to eliminate dangling or tangling of the strap. The strap as shown in FIG. 1C forms a convenient carrying handle. To convert the carrying handle to a back pack strap, the strap is separated at snaps 54, and threaded through a loop 56 sewn on the back of the bag (FIG. 1D) and around ring 52, and then resnapped as shown. The two strap portions formed between loop 56 and 50, 52 fit around the shoulders of the mother or father or other individual. I have found in practice that a strap length of 46–50 inches forms a convenient handle 22, when double backed, and fits virtually all individuals as a back pack strap as shown in FIG. 1D. Loop 56 may alternatively have one end secured to an end section of the bag and an opposite end adapted to be releasably attached to the middle section to retain the bag folded.

A zipper or other slide fastener 58 along the sides of sections 12 and 14 help retain the bag closed and steady, which is particularly important when the bag is used as a back pack. Further, I found that the zippers 58 enable a substantial number of diapers and additional paraphernalia to be stuffed into the bag, as is necessary for long trips.

Figure 1E:
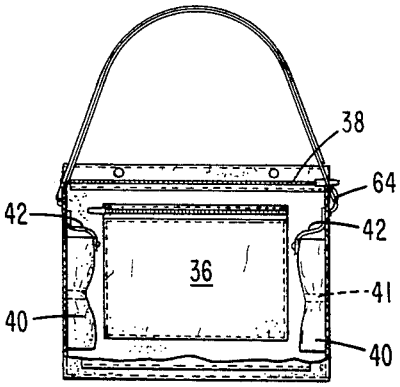
FIG. 1E is a view of one side of the bag, with a surface broken away to expose a number of accessory pockets.
Figure 1F:
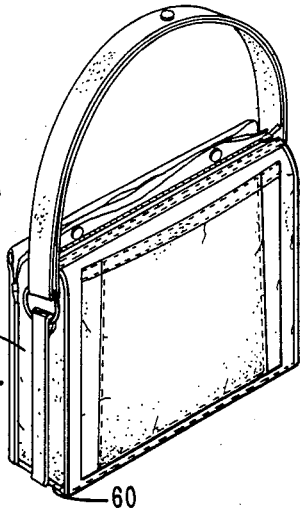
FIG. 1F is a perspective view of the carrying bag, loaded with supplies and sealed.

The bag 10 shown in FIG. 1F is formed with a stiffened base portion 60, enabling the bag 10 to stand upright on a support surface. The base 60 is preferably formed by doubling material back upon itself to form a multiple thickness section to establish the base without requiring any additional strips of material or stiffeners. Standoffs or feet 101 (FIG. 3C) may be inserted into the base 60 between the fold layers to hide rough edges. Sides 62 of the bag formed by appropriate stitching of the same material increase the storage capacity of the bag, making it possible, in my experience, to carry up to at least 30 diapers. To aid in loading the bag, the zipper 38 (FIG. 1E) has an end strip 64 that extends behind the side of the bag to enable the mouth of the pocket to expose substantially the entire storage volume of the pocket for more convenient loading and unloading.

Referring now to FIGS. 2A–2E, a second embodiment of the invention is shown wherein a combination diapering station and bag 64 is generally similar to the bag 10 shown in FIGS. 1A–1F but includes some modifications and additions. In FIG. 2A, pocket 66 in end section 68 stores clean diapers whereas soiled diapers are stored in removable pouch 70, similar to pouch 44 in FIG. 1A. In end section 72, additional pockets 74 and 76 provide further storage. The outer pocket 74 is a convenience pocket to receive small, preferably flat objects of a type that may be needed during diapering, such as wipe cloths. The larger pocket 76 is waterproof and is sealed shut by Velcro or equivant fastening strips 78, to retain pouch 70 and soiled diapers following changing. An inner, still larger pocket or tote 80, more conveniently accessible from the outer surface of the bag 64 contains a small, convenience, preferably zippered pocket 82 and an elastic sleeve 84 that may be used to retain credit cards, car keys or the like or may be formed slightly larger to retain infant bottles or jars.

At the rear of the bag 64 is located a flap 84 (FIG. 2D) that extends between the ends of handle 86. This flap is provided with a snap that couples to end section 68 to maintain the bag closed and provide the appearance of a handbag or tote.

The handle 88 is formed of a strap that is convertible, shown in FIG. 2E, to a back pack strap, similar to FIG. 1D. Again, the sides of the bag 64 are sealed by zippers 92 to enable the bag to carry a maximum volume load.

Also extending between the ends of handle 88 is a sleeve 90 which is adapted to receive a stiffening object, preferably a coiled bib, to provide rigidity to the load bearing end of the bag. Thus, the sleeve 90 forms two distinct functions, that is, a bib storage pocket and, when loaded with a bib, a stiffener.

Figure 3D:
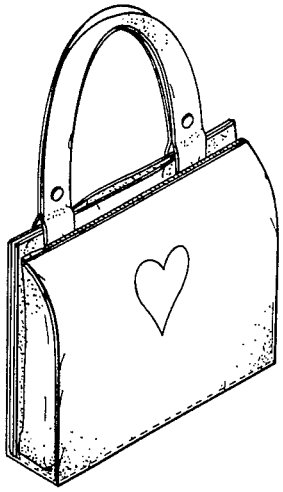
FIG. 3D is a perspective view of the bag more clearly illustrating the handle closure.
Figure 4A:
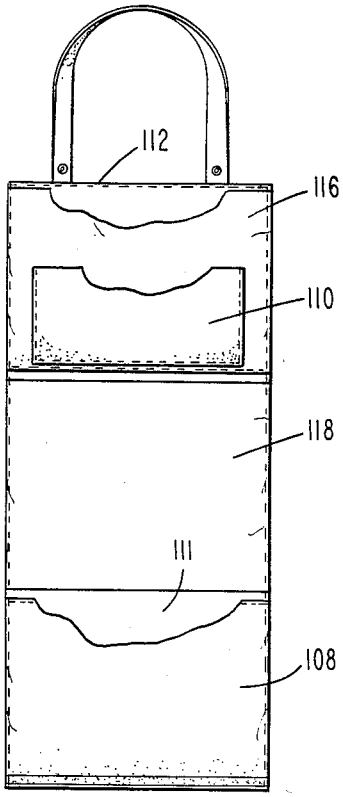
FIG. 4A shows a view of a fourth embodiment of the invention.
Figure 4B:
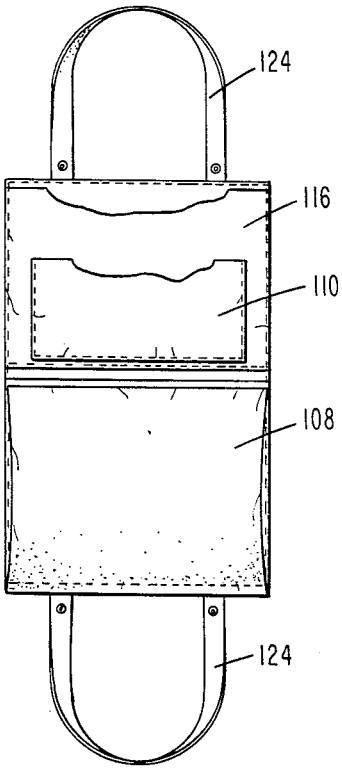
FIG. 4B is an illustration of the station of FIG. 4A following a first fold.
Figure 4C:
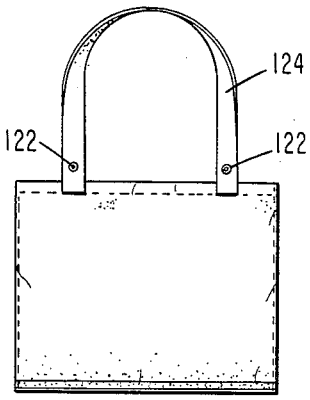
FIG. 4C is a rear view of the resultant bag following a second fold.
Figure 4D:
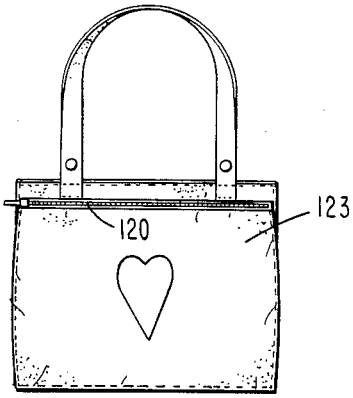
FIG. 4D is a front view of the bag.

FIGS. 3A–3D illustrate a further embodiment of the invention, similar to the embodiments described earlier but differing substantially in the manner by which the bag is closed and handles are attached. In FIG. 3A, a first handle 94 is sewn into the bag at end 96 of section 98 and a second handle 100 that is sewn to a flange or fold 107 formed at the outer surface of the bag, similar to flange 28 in FIG. 1B. Handle 94 is provided with a pair of snaps 102 adjacent section 98 and handle 100 has corresponding snaps 104.

The diapering station 93 is folded into a bag by folding end section 95 onto middle section 97, as shown in FIG. 3B, and making an additional fold to the bag of 3C. With the bag folded as in 3C, the snaps 102, 104 on handles 94, 100 are now coupled together, retaining the mouth of the bag shut. An advantage of locating the snaps 102, 104 on handles 94, 100 is to reduce costs while adding to the convenience of the bag; to open the bag and expose the contents, the two handles 94, 100 are merely separated to decouple the snaps. Furthermore, the provision of corresponding loop-type handles 94 adds to the tote-like appearance of the bag, shown in FIG. 3D.

FIGS. 4A–4D illustrate a low cost combination diapering station and bag 106 incorporating the principles of the embodiments shown in the preceding figures. The diapering station/bag 106 is again formed of a single piece of material, preferably a plastic or similar material that is low in cost and waterproof, and is provided with an inwardly facing pocket 108 on end section 111 to store clean diapers and cushion the infant's head and additional pockets 110, 112 formed in the opposite end section 116. The middle section 118 is provided with a diaper pouch open toward section 116 to enable diapers to be conveniently pulled from beneath the infant's buttocks. The pocket 110 conveniently stores small, relatively flat objects, such as wipes, needed when changing diapers. Additional diapers or other items are stored within the larger pocket 112.

The outer face of section 116 has a tote pocket 120 (FIG. 4D), preferably zippered by 123 and adapted to hold larger, bulky objects such as bottles, etc. in a manner shown in FIG. 1E.

The bag is maintained closed by handle snaps 122 provided on handle loops 124 in a manner similar to the embodiment of FIGS. 3A–3D.

In this disclosure, there is shown and described only the preferred embodiments of the invention, but as aforementioned, it is to be understood that the invention is capable of use in various other combinations and environments and is capable of changes or modifications within the scope of the inventive concept as expressed herein.

I claim:

1. A bag for carrying diapers and other paraphernalia, comprising a middle section and first and second end sections having approximately the same size, fold lines being established between adjacent sections to enable the end sections, in a folded position, to fold inwardly, one over the other, onto the middle section, a first pocket being provided on an inner surface of the first end section and having a side opened toward the middle section to retain diapers, a handle means formed of at least one continuous strap having at least one side secured to said bag, and means for releasably securing the bag in the folded position, wherein said handle means includes a first handle loop having ends secured to a free edge of said second end section, a U-shaped fold formed in the outer surface of the bag along the fold line between said first end section and said middle section; a second handle loop secured to said fold, and said releasably securing fastener means includes means on said handle loops to releasably secure together said loops.

2. The bag of claim 1, including a padding means in the first pocket to form a headrest.

3. The bag of claim 2, wherein the padding means comprises at least one diaper, folded flat within the first pocket.

4. The bag of claim 1, including a pouch having a moisture impervious inner surface for retaining diapers, and means for releasably securing the pouch to an inner surface of one of said bag sections.

5. The bag of claim 1, wherein the releasably securing means is provided at the middle section of said bag.

6. The bag of claim 4, wherein the pouch has one open end and means for releasably retaining the open end of the pouch closed.

7. The bag of claim 1 wherein said fastener means are positioned at corresponding points on said handle loops adjacent the bag.

8. The bag of claim 1, wherein said second end section is formed with at least one additional pocket.

9. The bag of claim 8, wherein said at least one additional pocket includes a loop at one side of the interior of the pocket to hold a bottle erect within the pocket.

10. The bag of claim 9, including an additional loop at an opposite side of the interior of the additional pocket to hold an additional bottle erect within the additional pocket.

11. The bag of claim 9, including a further pocket formed on an inner surface of said additional pocket to hold credit cards or the like.

12. The bag of claim 8, wherein said additional pocket is formed with a foldable side panel, and includes a slide fastener for enclosing a normally open side of the additional pocket, the slide fastener having a length larger than the length of said normally open side to enable the side panel of the additional pocket to be unfolded.

13. The bag of claim 1, wherein a portion of the second end section adjacent the middle section is doubled back to form a base for the bag.

14. The bag of claim 13, wherein the base of the bag is provided with standoffs.

15. The bag of claim 1, wherein the middle and first and second sections are formed of a single piece of material.

16. The bag of claim 8, including a bib positioned within said additional pocket.

17. The bag of claim 1, including a second pocket formed on the middle section and having a side open to the second end section, adapted to store diapers and provide a cushion.

* * * * *